US008505417B2

(12) United States Patent
Hui et al.

(10) Patent No.: US 8,505,417 B2
(45) Date of Patent: Aug. 13, 2013

(54) QUICKLY COUPLING SOCKET

(76) Inventors: Daivd Hui, Taipei (TW); Chien-Liang Lin, Taipei (TW)

( * ) Notice: Subject to any disclaimer, the term of this patent is extended or adjusted under 35 U.S.C. 154(b) by 205 days.

(21) Appl. No.: 13/136,336

(22) Filed: Aug. 1, 2011

(65) Prior Publication Data

US 2013/0032009 A1 Feb. 7, 2013

(51) Int. Cl.
*B25B 13/06* (2006.01)

(52) U.S. Cl.
USPC ..... 81/124.6; 81/121.1

(58) Field of Classification Search
USPC ..... 81/121.1, 124.6, 186
See application file for complete search history.

(56) References Cited

U.S. PATENT DOCUMENTS 2,202,240 A * 5/1940 Trotter ..... 81/124.6
2,777,353 A * 1/1957 Willis ..... 411/403
3,079,819 A * 3/1963 Wing ..... 81/124.6
3,242,775 A * 3/1966 Hinkle ..... 81/119
3,620,106 A * 11/1971 Dixon ..... 81/121.1
4,598,616 A * 7/1986 Colvin ..... 81/124.6
5,284,073 A * 2/1994 Wright et al. ..... 81/121.1
6,003,411 A * 12/1999 Knox et al. ..... 81/53.2
6,263,769 B1 * 7/2001 Macor ..... 81/119
7,228,764 B1 * 6/2007 Macor ..... 81/121.1
7,311,022 B2 * 12/2007 Putney et al. ..... 81/125
7,523,688 B2 * 4/2009 Putney et al. ..... 76/114
2012/0285298 A1 * 11/2012 Richardson et al. ..... 81/124.6

* cited by examiner

*Primary Examiner* — David B Thomas

(57) ABSTRACT

A socket includes a plurality of protrusions circumferentially disposed around a circular top opening in a top portion of the socket, whereby upon insertion of a driving (or coupling) shaft of a spanner with square head portion into the square hole in the socket, the square head portion of the driving shaft will be respectively biased or thrusted by the protrusions and then smoothly guided or slid through a sloping surface tapered downwardly radially from the circular opening into the square hole for quickly coupling the driving shaft of the spanner with the square hole in the socket.

A socket further includes plural bottom protrusions disposed around a circular bottom opening in a bottom portion of the socket, and eighteen faces formed in a hexagonal bottom hole of the socket for helping a quick coupling of a nut or bolt into the bottom hole of the socket.

8 Claims, 7 Drawing Sheets

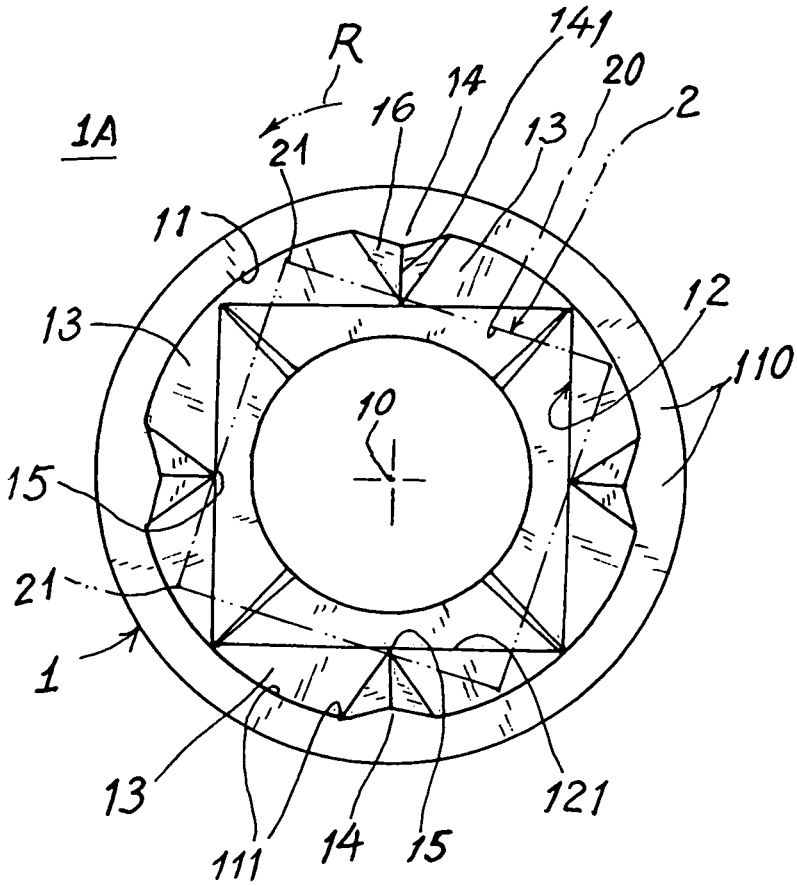
Fig. 3
Fig. 4
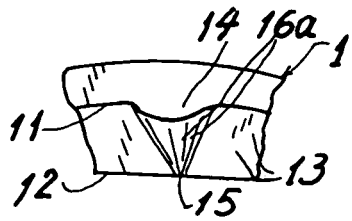

QUICKLY COUPLING SOCKET

BACKGROUND OF THE INVENTION

A conventional socket S, adapted for coupling a nut or bolt into a lower hole of the socket for rotatably fastening or unfastening the nut or bolt, includes a sloping circular opening T inclinedly formed in a top portion of the socket and a square hole H formed in the upper portion of the socket for coupling a driving (or coupling) shaft C into the square hole H as downwardly slid through the sloping circular opening T.

However, the right-angled corners C1 of the driving (or coupling) shaft C may be quadrilaterally retained on the sloping surfaces of the circular opening T as dotted line shown in FIG. 9. The user or operator must further twist or rotate the driving shaft C about the axis 10 either anti-clockwise R or clockwise R1 until matching the right-angled corners C1 of the shaft C with the square hole H of the socket S in order for stably coupling the shaft C into the socket hole H, thereby causing operating inconvenience for the tool user.

A conventional socket S has its bottom portion 1B formed with a hexagonal hole Hb to be engaged with a hexagonal nut or bolt N as shown in FIG. 10. When the apex corners X of the nut or bolt have been worn as curved corners, the worn nut or bolt may be slipped or slid when rotating the socket for driving the nut or bolt, thereby influencing a smooth engagement between the socket and the nut (or bolt) or delaying the driving operation for fastening the nut (or bolt).

The present inventor has found the drawbacks of the conventional socket and invented the present socket for quickly coupling driving tools, nuts or bolts.

SUMMARY OF THE INVENTION

The object of the present invention is to provide a socket including a plurality of protrusions circumferentially disposed around a circular opening in a top portion of the socket, each protrusion formed at a central portion of a quarter arc length corresponding to a square side of a square hole formed in the socket, whereby upon a downward insertion of a driving (or coupling) shaft of a spanner with square head portion (having four right-angled corners) into the square hole in the socket, the square head portion of the driving shaft will be respectively biased or thrusted by the protrusions and then smoothly guided or slid through a sloping surface tapered downwardly radially from the circular opening into the square hole for quickly coupling the driving shaft of the spanner with the square hole in the socket for stably rotating the socket for fastening or unfastening a nut or bolt engaged into a lower hole in the socket.

Another object of the present invention is to provide a socket having a plurality of bottom protrusions circumferentially disposed around a circular bottom opening of the socket to help thrust a nut or bolt to be slid along a bottom sloping conical surface to be quickly coupled into a bottom hole of the socket.

Still another object of the present invention is to provide a socket having eighteen faces of a hexagonal hole formed in the bottom of the socket to help a quick coincidence between the socket and a nut or bolt for their quick coupling.

BRIEF DESCRIPTION OF THE DRAWINGS

FIG. 3 is a top-view illustration of the present invention when a driving shaft is biased anti-clockwise from FIG. 2.

FIG. 4 shows another preferred embodiment of the protrusion of the present invention.

DETAILED DESCRIPTION

Figure 1:
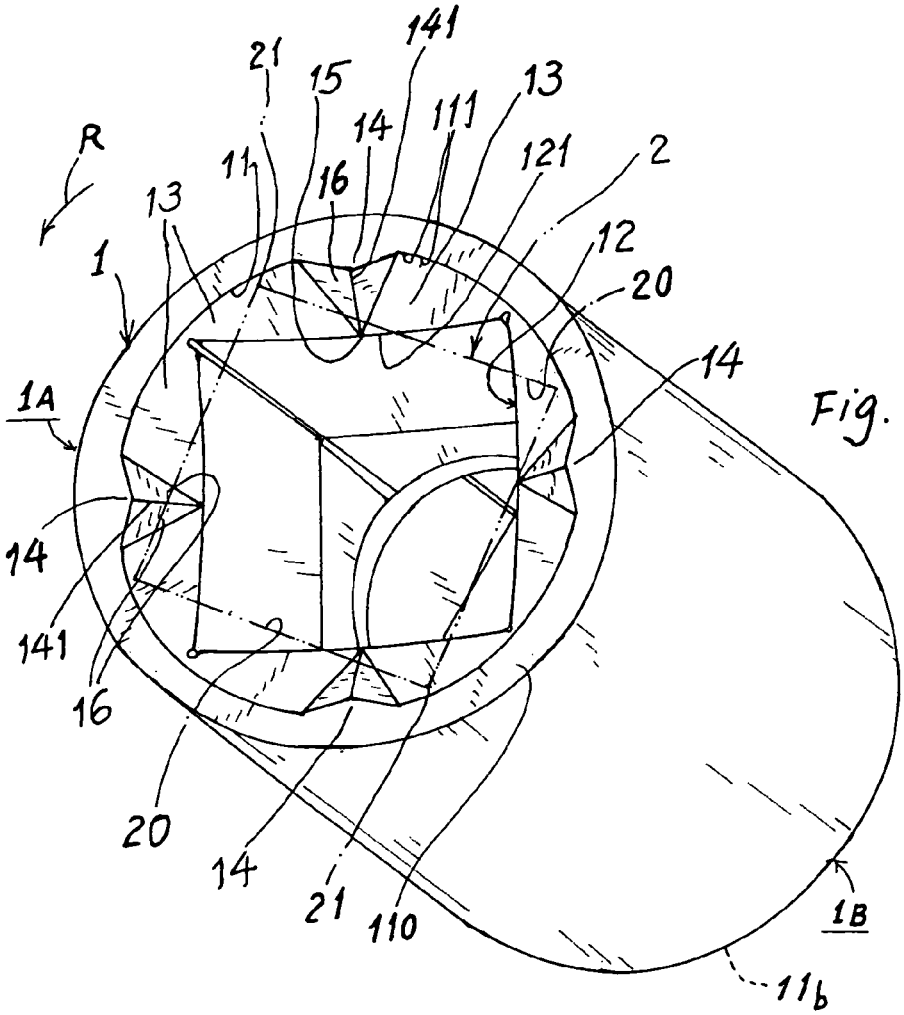
FIG. 1 is a perspective view of the present invention.
Figure 2:
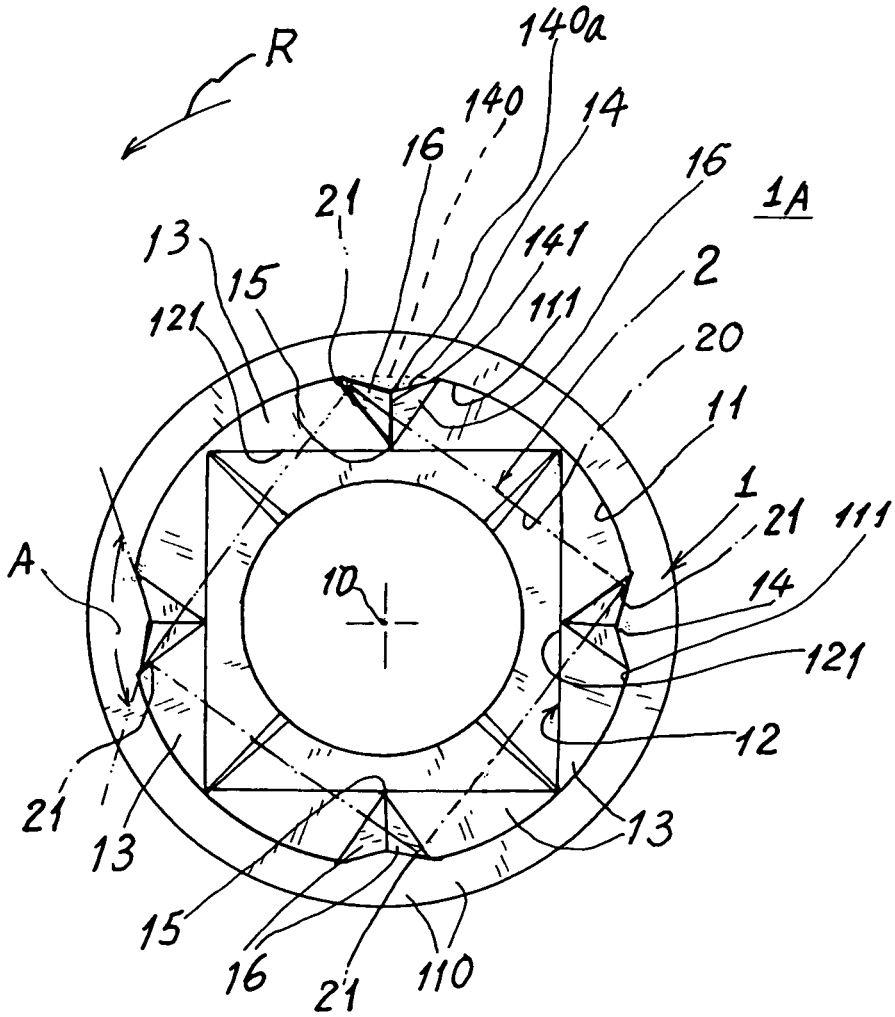
FIG. 2 is a top-view illustration of the present invention.

As shown in FIGS. 1 and 2, the present invention comprises a socket 1 of a spanner or the like for fastening or unfastening a nut or bolt as engaged in a bottom hole formed in a bottom or lower portion of the socket 1, including a plurality of protrusions 14 circumferentially disposed around a circular top opening 11 formed in a top portion of the socket 1, a square hole 12 formed in an upper portion of the socket 1 and communicated with the circular top opening 11 through a sloping conical surface 13 tapered downwardly radially from the circular top opening 11 (about an axis 10 of the socket 1) towards the square hole 12 for engaging a square head of the driving (or coupling) shaft 2 of the spanner having four right-angled corners 21 of the square head portion.

Each protrusion 14 may be formed as a pyramidal shape, a conical or semi-conical shape, a cylindrical shape, a curved shape or a polygonal shape, not limited in the present invention.

As shown in the drawing figures of this invention, there are four protrusions 4 circumferentially disposed on the top surface of the socket 1.

There should, however, be at least one protrusion 14 formed on the top surface of the socket 1 in accordance with the present invention.

The protrusion 14 is formed as a pyramidal shape at a central or middle portion of a quarter arc length 111 of the circular opening 11 of the socket 1, with the quarter arc length 11 corresponding to each square side 121 of the square hole 12 of the socket; and each protrusion 14 including a triangular base 140 coplanar to an annular top surface 110 confining the circular opening 11, two triangular sides 16 respectively tapered convergently downwardly along the sloping surface 13 and a ridge line 141 to be tangentially intersected at a focusing end point 15 at a central portion of each square side 121 of the square hole 12, and the ridge line 141 linearly joining the two triangular sides 16 and tapered downwardly radially from a triangular apex 140*a* of the triangular base 140 towards the focusing end point 15.

Two upper sides of the two triangular sides 16 define an obtuse angle A as shown in FIG. 2. The obtuse angle A is so designed to be not so acute to prevent injury to the driving (or coupling) shaft of a spanner when coupling the driving shaft 2 with the socket 1 of the present invention. The obtuse angle A may be 150 degrees, or any other obtuse angles, not limited in this invention.

When downwardly pressing the driving shaft 2 having four right-angled corners 21 of the four square sides 20 (as dotted line shown) of the square head of the shaft 2 into the circular opening 11 of the socket 1 as shown in FIG. 2, if the right-angled corner 21 of the driving shaft 2 is snugly landed at the triangular side 16 of the protrusion 14, the driving shaft 2 will be sidewardly biased or thrusted as anti-clockwise (R) as shown in FIG. 2 by the sloping triangular sides 16 from FIG.

2 to FIG. 3, whereby a further downward pressing of the driving shaft 2, the square head of the driving shaft 2 will be smoothly quickly guided and slid by the sloping surface 13 of the socket 1 in an anti-clockwise direction R to be coupled into the square hole 12 of the socket 1.

By the way, the driving shaft 2 of a spanner or the like will be rotated to drive the socket 1 as coupled to the shaft 2 to fasten or unfasten a nut or bolt as engaged in a lower portion of the socket.

The protrusions 14 on the socket 1 of the present invention may help guide the head of the driving shaft 2 to be coupled with the socket hole 12 quickly, smoothly and conveniently, to thereby facilitate the operation for fastening or unfastening a nut or bolt as engaged with the socket.

As shown in FIG. 1, if the right-angled corner 21 of the driving shaft 2 is snugly landed at the sloping surface 13 of the socket 2 when downwardly pressing the shaft 2 into the socket 1, the square sides 20 of the shaft 2 may each be retained against each ridge line 141 of the protrusion 14 and a further depression of the shaft 2, the head of the shaft 2 will be driven in an anti-clockwise (R) direction only, without being driven clockwise since the sides 20 of the shaft 2 have been respectively retained or retarded by the ridge lines 141 of the protrusions 14, to thereby be quickly guided, slid and coupled into the socket hole 12.

Figure 9:
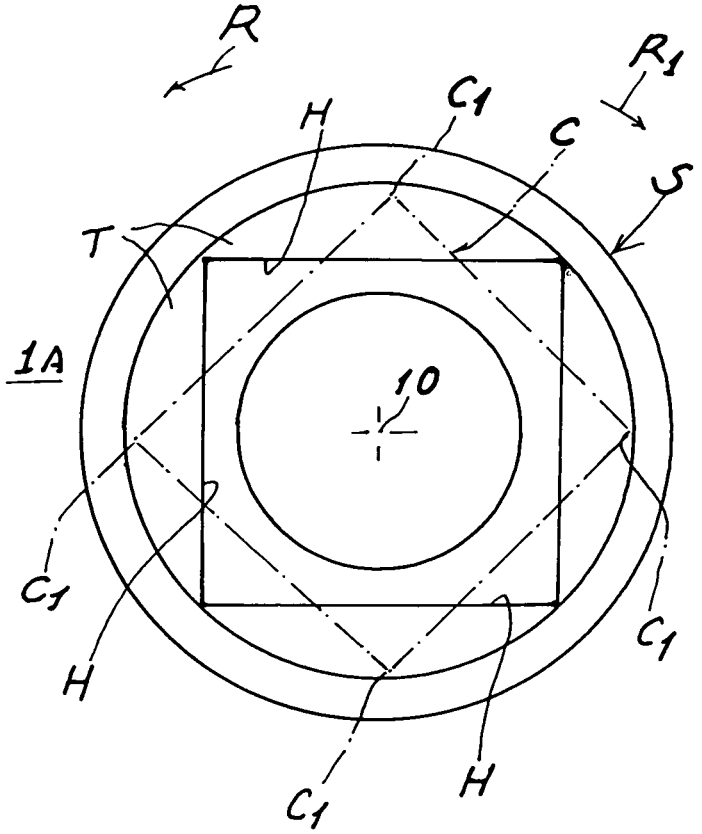
PRIOR ART Fig. 9
FIG. 9 is a top-view illustration of a prior art.
Figure 10:
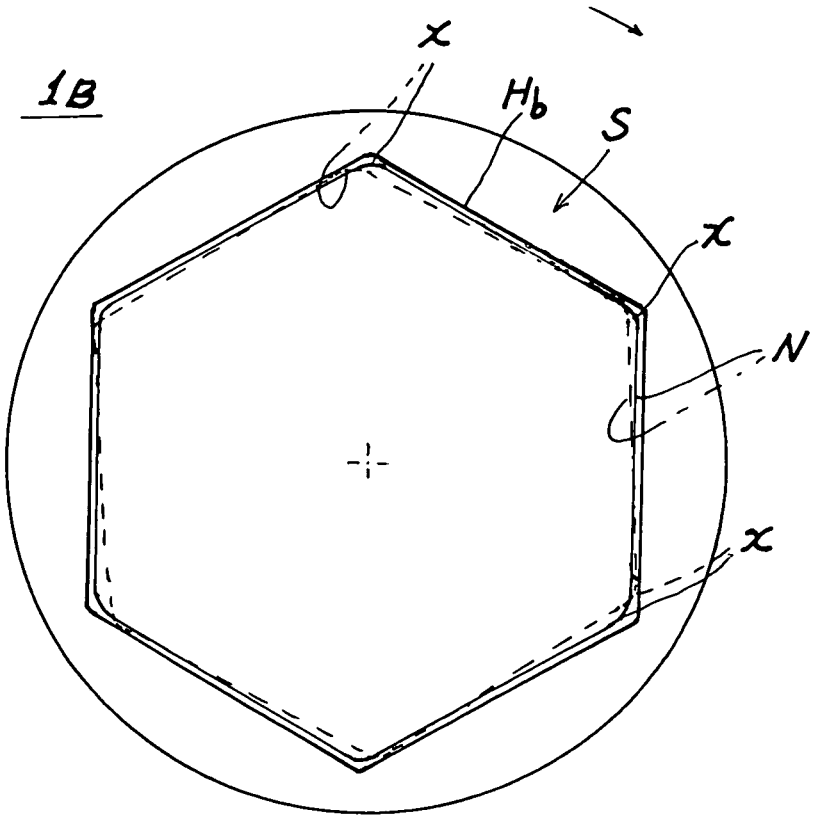
Fig. 10 PRIOR ART
FIG. 10 is a bottom-view illustration of a prior art.

Comparatively, if there is not provided with any protrusion 14 as taught by this invention, the shaft head may be rotated either clockwise or anticlockwise for "traveling" a longer distance or arc length, trying to couple the driving shaft with a conventional socket (FIG. 9), thereby delaying the coupling operation and causing inconvenience for the operator or user.

As shown in FIG. 4, the protrusion 14 has been modified to be a conical or semi-conical protrusion having curved sloping sides 16*a* tapered downwardly to be conveniently intersected at the end point 15 (or side edge) at the square side 12 of the socket 1.

Figure 5:
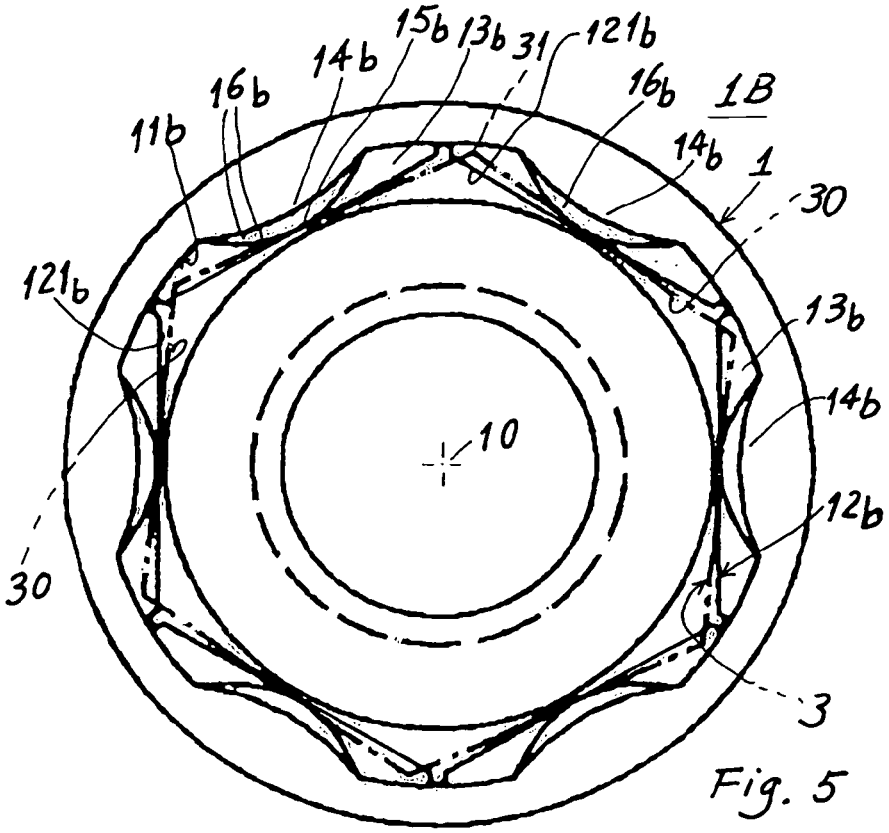
FIG. 5 is a bottom-view illustration of the present invention intended to be coupled with a nut.
Figure 6:
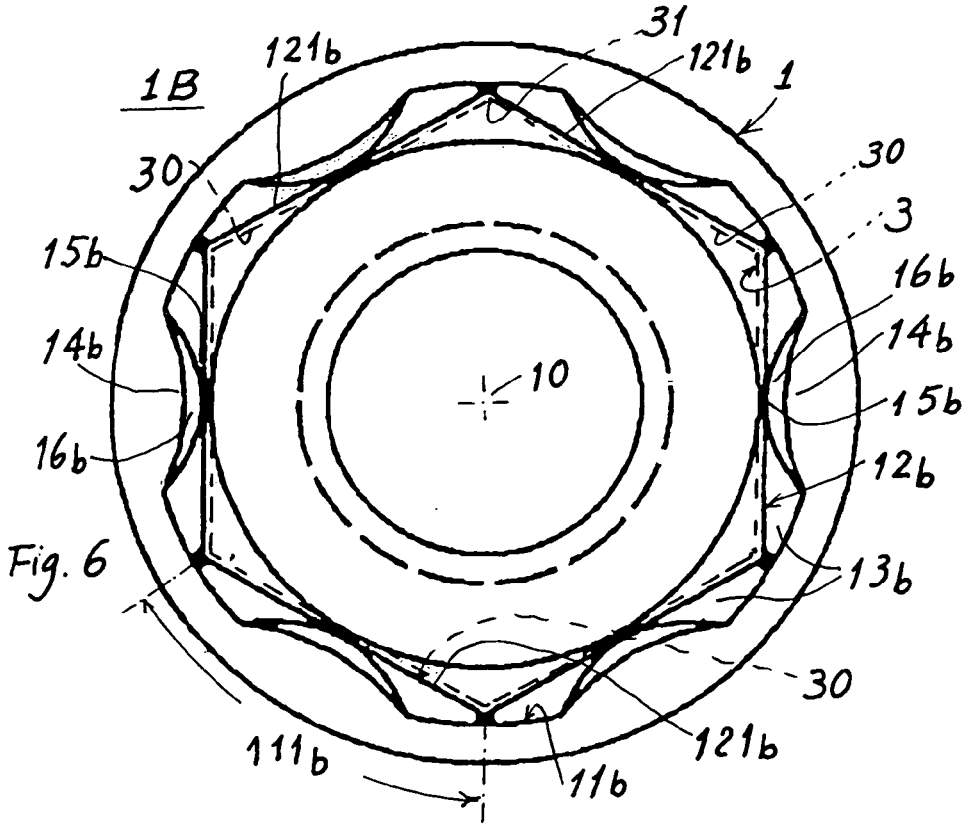
FIG. 6 is a bottom illustration showing a snug coupling of the nut in the socket.

As shown in FIGS. 5 and 6, a bottom or lower portion 1B of the socket 1 includes a hexagonal (or polygonal) hole 12*b* formed therein for engaging a hexagonal (or polygonal) nut or bolt 3, and a plurality of bottom protrusions 14*b* circumferentially disposed around a circular bottom opening 11*b* formed in the bottom of the socket 1; with the hexagonal (or polygonal) hole 12*b* communicated with the circular bottom opening 11*b* through a bottom sloping conical surface 13*b* tapered upwardly radially from the circular bottom opening 11*b* (about the axis 10 of the socket 1) towards the hexagonal hole 12*b*.

Each bottom protrusion 14*b* may be formed as semi-conical shape, semi-cylindrical shape, curved shape, or any other suitable shapes.

Each bottom protrusion 14*b* is formed at a central or middle portion of a sixth (⅙) arc length 111*b* of the circular bottom opening 11*b*, with the sixth arc length 111*b* corresponding to each hexagonal side 121*b* of the hexagonal hole 12*b* of the socket 1; each bottom protrusion 14*b* tapered convergently upwardly along the bottom sloping conical surface 13*b* to be tangentially intersected with each side edge of the hexagonal side 121*b* (FIG. 6).

When forcibly engaging the socket 1 with a nut (or bolt) 3, each apex corner 31 of the nut (or bolt) 3 will be quickly guided and slid by the sloping surface 13*b* as thrusted by each bottom protrusion 14*b* as shown from FIG. 5 to FIG. 6 to thereby snugly couple the hexagonal nut (or bolt) within the hexagonal hole 12*b* in the socket 1 for quickly coupling the nut (or bolt) with the socket 1 at the bottom or lower portion of the socket, acting in a manner like the quick engagement of the driving shaft 2 with the square hole 12 formed in an upper portion of the socket 1 as aforementioned or illustrated in FIGS. 1~3.

By the way, the socket 1 of the present invention may quickly couple a driving shaft or tool in an upper or top side of the socket 1 (FIGS. 1~3), and may also quickly couple the nut or bolt 3 in a lower or bottom side of the socket 1 (FIGS. 5~6), thereby being satisfactorily defined as "Quickly Coupling Socket" as shown in the title of this invention.

Still, the present invention may be further modified to be a quickly reliable coupling of the socket 1 with a nut or bolt 3 as hereinafter described and illustrated in FIGS. 7 and 8.

Figure 7:
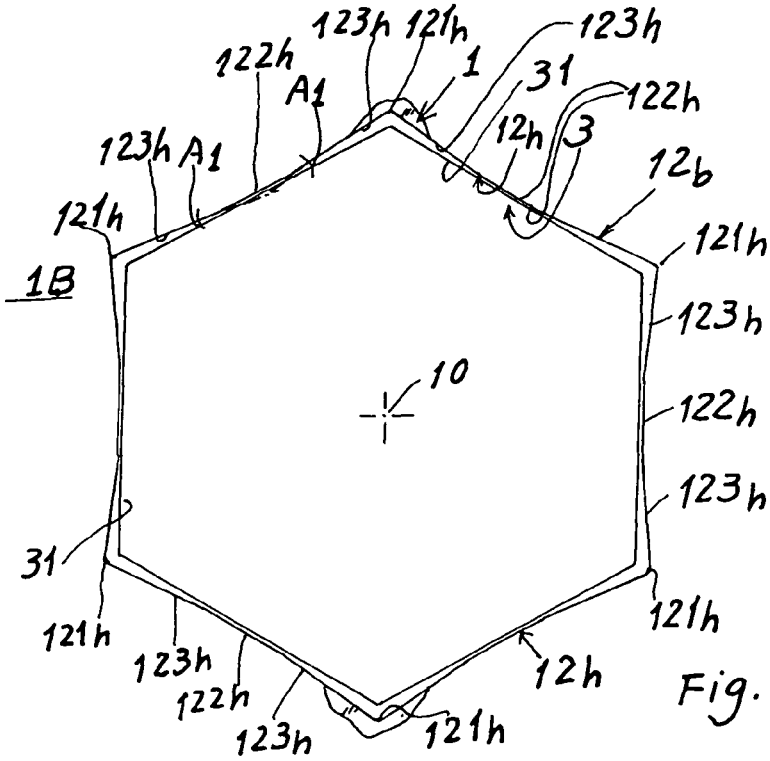
FIG. 7 is a bottom illustration of a 18-face socket of the present invention.

As shown in FIG. 7, each hexagonal side 12*h* of a hexagonal hole 12*b* formed in a lower or bottom portion 1B of the socket 1 includes: an intermediate sub-side 122*h* juxtapositioned to a hexagonal side 31 of a nut or bolt 3 as engaged in the hole 12*b* of the socket 1, two inclined sub-sides (or inclined partial sides) 123*h* respectively inclined outwardly divergently from the intermediate sub-side 122*h*; each inclined sub-side 123*h* inwardly extrapolatively defining a small acute angle A1 between each inclined sub-side 123*h* and a corresponding nut (or bolt) side 31 of a hexagonal nut (or bolt) 3; the intermediate sub-side 122*h* transversely intersected with the two inclined sub-sides 123*h* disposed on opposite ends of the intermediate sub-side 122*h*; and each inclined sub-side 123*h* outwardly intersected at an apex 121*h* with a neighboring inclined sub-side 123*h* of another hexagonal side 12*h* as hexagonally forming the hexagonal hole 12*b* of the socket 1 (on the bottom portion 1B).

Figure 8:
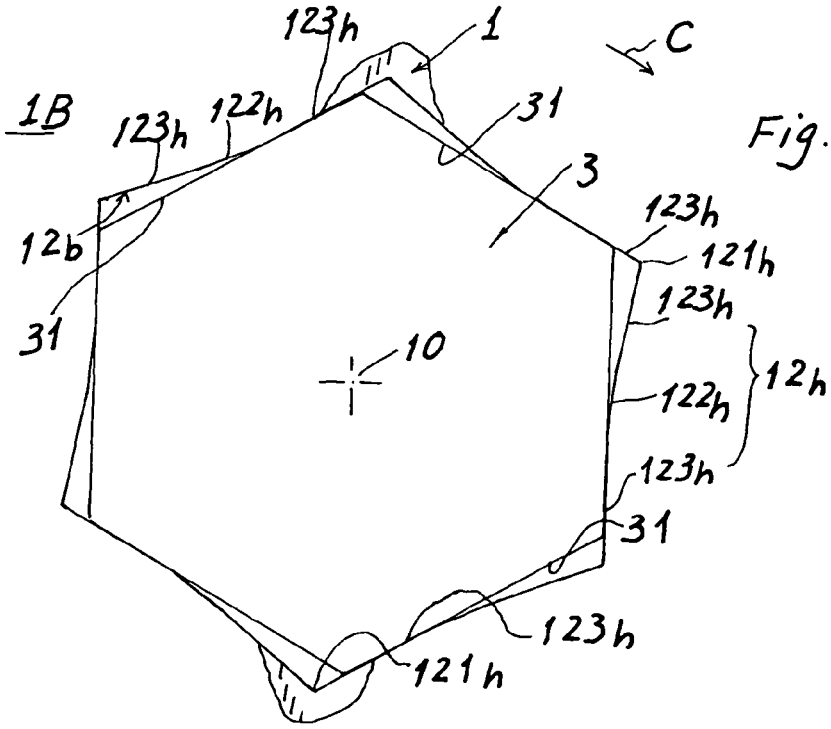
FIG. 8 shows the planar coincidence of the socket sub-sides with the nut sides as rotated from FIG. 7.

Upon a rotation (such as a clockwise rotation C as shown in FIG. 8) of the socket 1, each inclined sub-side 123*h* of the socket 1 will rotate in the small acute angle A1 to be immediately coincided with each nut (or bolt) side 31 of the nut (or bolt) 3. By the way, the hexagonal sides 31 of the nut (or bolt) are reliably engaged or contacted with the respective inclined sub-sides 123*h* planarly (not linearly) without being slipped or slid, thereby ensuring a quick coupling of the socket and the nut (or bolt).

The hexagonal sides 12*h* may also be modified to be other polygonal sides for a polygonal socket or a nut (or bolt).

As shown in FIGS. 7 and 8, each hexagonal side 12*h* is "divided" into three sub-sides, namely, one intermediate sub-side 122*h* and two inclined sub-sides 123*h* on opposite ends of the intermediate sub-side 122*h*. Since each hexagonal side 12*h* has "three faces", the hexagonal hole 12*h* will have "18 faces" (3 faces×6=18 faces) totally.

The present invention may be modified without departing from the spirit and scope of the present invention.

We claim:

1. A socket, adapted for rotatably fastening or unfastening a nut or bolt as driven by a spanner or the like, comprising:

a plurality of protrusions circumferentially disposed about a circular opening formed in a top portion of the socket, a square hole formed in an upper portion of the socket and communicated with said circular opening through a sloping conical surface tapered downwardly radially from said circular opening towards said square hole for engaging a square head of a driving shaft of the spanner, whereby upon downward pressing of said driving shaft into said square hole in said socket, said square head of said driving shaft will be biased or thrusted by said protrusions in order to be quickly coupled into said square hole in said socket as slid through said sloping conical surface.

2. A socket according to claim 1, wherein said protrusion is formed as a shape selected from: a pyramidal shape, a conical shape, a semi-conical shape, a cylindrical shape, a curved shape and a polygonal shape.

3. A socket according to claim 1, wherein at least one said protrusion is formed at a central portion of a quarter arc length of said circular opening of said socket; said quarter arc length corresponding to each square side of the square hole of said socket, with said square hole communicated with said circular opening through said sloping conical surface.

4. A socket according to claim 3, wherein each said protrusion includes a triangular base coplanar to an annular top surface confining the circular opening, two triangular sides respectively tapered convergently downwardly along the sloping conical surface and a ridge line to be tangentially intersected at a focusing end point at a central portion of each square side of the square hole, and the ridge line linearly joining the two triangular sides and tapered downwardly radially from a triangular apex of the triangular base towards the focusing end point.

5. A socket according to claim 4, wherein said triangular base includes two upper sides of the two triangular sides defining an obtuse angle between said two upper sides.

6. A socket according to claim 5, wherein each said obtuse angle is 150 degrees.

7. A socket according to claim 1, adapted for rotatably fastening or unfastening a nut or bolt as driven by a spanner or the like, comprising:

a plurality of protrusions circumferentially disposed about a circular opening formed in a top portion of the socket, a square hole formed in an upper portion of the socket and communicated with said circular opening through a sloping conical surface tapered downwardly radially from said circular opening towards said square hole for engaging a square head of a driving shaft of the spanner, whereby upon downward pressing of said driving shaft into said square hole in said socket, said square head of said driving shaft will be biased or thrusted by said protrusions in order to be quickly coupled into said square hole in said socket as slid through said sloping conical surface; and said socket having a hexagonal hole formed in the bottom of said socket for coupling a nut or bolt, and comprising a plurality of bottom protrusions circumferentially disposed around a circular bottom opening formed in the bottom of the socket;

each said bottom protrusion formed at a central or middle portion of a sixth arc length of the circular bottom opening, with the sixth arc length corresponding to each hexagonal side of the hexagonal hole of the socket; each said bottom protrusion tapered convergently upwardly along a bottom sloping conical surface to be tangentially intersected with a side edge of a hexagonal side of the hexagonal hole of the socket.

8. A socket having a hexagonal hole formed in the bottom of the socket; said hexagonal hole having six hexagonal sides;

each said hexagonal side including: an intermediate sub-side juxtapositioned to a hexagonal nut or bolt side, two inclined sub-sides respectively inclined outwardly divergently from the intermediate sub-side; each said inclined sub-side inwardly extrapolatively defining a small acute angle between each said inclined sub-side and a corresponding nut or bolt side of a hexagonal nut or bolt; the intermediate sub-side transversely intersected with the two inclined sub-sides disposed on opposite ends of the intermediate sub-side; and each said inclined sub-side outwardly intersected at an apex with a neighboring inclined sub-side of another hexagonal side as hexagonally forming the hexagonal hole of the socket; whereby upon rotation of the socket, each said inclined sub-side of the socket will rotate in the small acute angle to be coincided with each nut or bolt side for quickly coupling the nut or bolt in the socket.

* * * * *